United States Patent [19]

Akizuki

[11] Patent Number: 4,945,455

[45] Date of Patent: Jul. 31, 1990

[54] AUTOMOTIVE PROJECTOR-TYPE HEADLAMP

[75] Inventor: Kunio Akizuki, Shiraokamachi, Japan

[73] Assignee: Ichikoh Industries Ltd., Tokyo, Japan

[21] Appl. No.: 443,400

[22] Filed: Nov. 30, 1989

[30] Foreign Application Priority Data

Nov. 30, 1988 [JP] Japan ..... 63-300972

[51] Int. Cl.[5] ..... F21V 7/08; F21V 13/04

[52] U.S. Cl. ..... 362/61; 362/298; 362/308; 362/346; 362/348

[58] Field of Search ..... 362/61, 297, 298, 299, 362/308, 346, 347, 348

[56] References Cited

U.S. PATENT DOCUMENTS

| | | | |
|---|---|---|---|
| 1,621,585 | 3/1927 | Godley | 362/348 |
| 1,621,752 | 3/1927 | Raynolds | 362/348 |
| 1,883,360 | 10/1932 | Fortney | 362/297 |
| 3,427,447 | 2/1968 | Clark | 362/299 |
| 4,234,247 | 11/1980 | Dorman | 362/804 |
| 4,669,032 | 5/1987 | Lietar et al. | 362/61 |
| 4,779,179 | 10/1988 | Oyama et al. | 362/346 |
| 4,803,601 | 2/1989 | Collot et al. | 362/346 |

*Primary Examiner*—Ira S. Lazarus
*Assistant Examiner*—Richard R. Cole
*Attorney, Agent, or Firm*—Foley & Lardner, Schwartz, Jeffery, Schwaab, Mack, Blumenthal & Evans

[57] ABSTRACT

The inner reflecting surface of the concave mirror of the projector-type headlamp is composed of a central spherical area and a composite ellipsoidal surface of revolution formed by parts of a plurality of different ellipsoidal surfaces of revolution, smoothly joined to each other for junction with the central spherical area, having a common focus at the center of the spherical area and other foci, respectively, at positions spaced ahead of a predetermined distance from the common focus. The lamp bulb is so disposed so as to have the center thereof located near the common focus, and the convex lens is so disposed as to have the focus thereof located near the common focus. The ellipsoidal surfaces of revoltion are so shaped geometrically as to reflect in directions toward their respective other foci the rays emitted from the lamp bulb and incident upon the ellipsoidal surrfaces of revolution, and the convex lens is so designed as to have the focus thereof located near the common focus of the ellipsoidal surfaces of revolution at which the lamp bulb is located. Thereby, it is possible to decrease the total length of the optical system, design compact the entire structure of the projector-type headlamp and increase the effective solid angle of the rays emitted from the lamp bulb, thereby permitting to utilize the rays from the lamp bulb to full extent for definition of a predetermined luminous intensity distribution pattern.

8 Claims, 4 Drawing Sheets

AUTOMOTIVE PROJECTOR-TYPE HEADLAMP

BACKGROUND OF THE INVENTION (a) Field of the Invention

The present invention relates to a so-called automotive projector-type headlamp comprising a concave mirror, a lamp bulb disposed as light source near the focus of the concave mirror and a convex lens disposed in front of the concave mirror, and more particularly to a projector-type headlamp compact as a whole of which the distance between the apex of the concave mirror and the front surface of the convex lens is relatively short.

(b) Description of the Related Art

The automotive projector-type headlamp is basically composed of a concave mirror, a lamp bulb disposed as light source near the focus of the concave mirror and a convex lens disposed in front of the concave mirror. Projector-type headlamps have so far been proposed of which the concave mirrors are different from one another in geometrical shape of the inner reflecting surface.

FIG. 1 schematically shows the optical system of a typical conventional projector-type headlamp composed of a concave mirror 1, whose inner reflecting surface is an ellipsoidal surface of revolution and which has an optical axis Z passing through the apex thereof, a lamp bulb 3, whose filament center is disposed near the first focus F1' of the concave mirror 1, and a convex lens 2, whose focus is so disposed as to be nearly coincident with the second focus F2' of the concave mirror 1.

Such an optical system is so configured that the light rays emitted from the first focus F1'and reflected at the concave mirror 1 (whose inner reflecting surface is an ellipsoidal surface of revolution) converge at the second focus F2'. Since the second focus F2' is so disposed as to be nearly coincident with the focus of the convex lens 2, the rays incident upon the convex lens 2 are so refracted by the latter as to be projected ahead nearly parallel to the optical axis as indicated with the arrows a and a'. In the case of a headlamp having the concave mirror 1 whose inner reflecting surface is an ellipsoidal surface of revolution, the distance L between the apex of the concave mirror and the front face of the convex lens must be kept relatively long. Hence, it is unavoidable that the headlamp is of a structure horizontal and long as a whole. Installing a headlamp of this type in the body of a car requires a relatively large space. Namely, installing such a headlamp in a car body is difficult.

To solve the problem of the headlamp using a concave mirror shown in FIG. 1, or to overcome installation difficulties of the headlamp in a car body due to the horizontally long structure thereof, a projector-type headlamp has been proposed as disclosed in the Japanese Unexamined Patent Publication No. 63-66801 FIG. 2 schematically shows an optical system of the proposed headlamp. This headlamp comprises a concave mirror 4 whose inner reflecting surface is spherical, a lamp bulb 3 whose filament center is disposed near the center O of the concave mirror 4, and a convex lens 2 disposed in front of the concave mirror 4 and having the focus thereof disposed near the center of the concave mirror 4. The light rays emitted from the lamp bulb 3 and reflected by the concave or spherical mirror 4 pass again near the center 0 of the spherical mirror 4, then are incident upon the convex lens 2, refracted by the latter and projected forward nearly parallel to the optical axis Z as indicated with the arrows b and b' The rays emitted from the light source or lamp bulb 3 and incident directly upon the convex lens 2 are similarly refracted by the latter and projected ahead nearly parallel to the optical axis Z as indicated with the arrows b and b'.

In the headlamp with the concave mirror 4 whose inner reflecting surface is spherical, the solid angle 1' of viewing from the light source 3 the circumference of the spherical mirror 4 and the solid angle $\theta 2'$ of viewing from the light source 3 the circumference of the convex lens 2 are so set as to be equal to each other. However, it is difficult to design the headlamp for larger solid angles $\theta 1'$ and $\theta 2'$, and the rays cannot be utilized effectively. Further, in this headlamp, the nearly parallel rays (indicated with the arrows b and b') from the convex lens 2 should appropriately diverge as in case of the optical system using the convex mirror as shown in FIG. 1. For this purpose, an outer lens (not shown) should be provided in front of the convex lens 2 to diverge the rays or the convex lens 2 should be a special deformed one. In addition, the rays reflected by the spherical mirror 4 and traveling toward the convex lens 2 are intercepted by a rather large amount by the light source 3 disposed near the center of the spherical surface.

SUMMARY OF THE INVENTION

The present invention has an object to overcome the above-mentioned drawbacks of the conventional automotive projector-type headlamps by providing a projector-type headlamp whose entire structure is designed compact and having an improved concave mirror which permits to effectively utilize the light rays emitted from the light source for the illumination ahead of a car.

Another object of the present invention is to provide a projector-type headlamp having an improved concave mirror so designed as to diverge the rays horizontally in order to provide a desired luminous intensity distribution pattern, without using any outer lens or the like disposed outside the convex lens to diverge the rays.

The above-mentioned objects are attained by providing a projector-type headlamp comprising, according to the present invention, a concave mirror having an inner reflecting surface, a lamp bulb as light source of which the center nearly falls on the axis of the concave mirror, and a convex lens so disposed as to have the optical axis thereof nearly coincident with the axis of the concave mirror, the inner reflecting surface of the concave mirror being composed, at an area near the apex, of a central spherical area formed by part of a spherical surface and having the center thereof disposed on the axis of the concave mirror and a composite ellipsoidal surface of revolution formed by parts of a plurality of ellipsoidal surfaces of revolution smoothly joined to each other for junction with the central spherical area, having a common focus at the center of the spherical area and other foci at positions spaced a predetermined distance from the common focus toward the convex lens, the lamp bulb having its center disposed near the common focus and the convex lens having its focus disposed near the common focus.

The light rays emitted from the lamp bulb and incident upon each of the ellipsoidal surfaces of revolution are reflected in directions toward the other focus. The rays thus reflected by the ellipsoidal surfaces of revolution are refracted in different directions by the convex lens which permits to diverge the light rays in different horizontal directions, to define in the luminous intensity distribution pattern a horizontally long illuminated area extending horizontally from the center of the pattern. The rays emitted from the lamp bulb and incident directly upon the convex lens and those emitted from the lamp bulb, reflected at the central spherical area of the concave mirror and then incident upon the convex lens are refracted in directions nearly parallel to the optical axis in order to define in the luminous intensity distribution pattern a relatively high luminous intensity area near the center of the pattern. The shape of the luminous intensity distribution pattern, especially, the shape of the horizontally long illuminated area extending horizontally from the central area, depends upon the horizontal light convergence due to each of the ellipsoidal surfaces of revolution. Therefore, the rays emitted from the lamp bulb are effectively utilized to form a desired luminous intensity distribution pattern ahead of the convex lens. Since the focus of the convex lens is disposed near the common focus of the ellipsoidal surfaces of revolution optical system can be reduced, and thus the entire structure of the projector-type headlamp can be compact.

These and other objects and advantages of the present invention will be better understood from the ensuing description made by way of examples of the embodiments of the automotive projector-type headlamp according to the present invention with reference to the drawings.

DETAILED DESCRIPTION OF THE PREFERRED EMBODIMENTS

Figure 1:
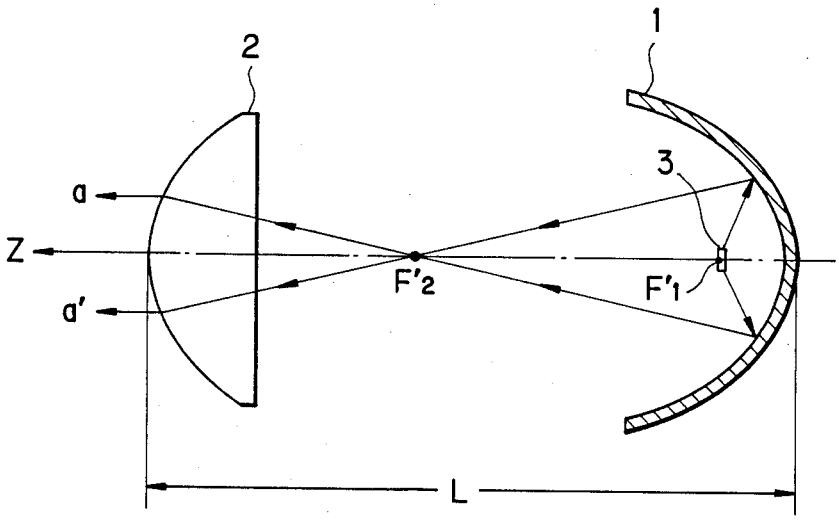
Fig. 1 (PRIOR ART)
FIG. 1 is a schematic explanatory drawing of the optical system of a conventional projector-type headlamp using a single ellipsoidal surface of revolution as the concave mirror.
Figure 2:
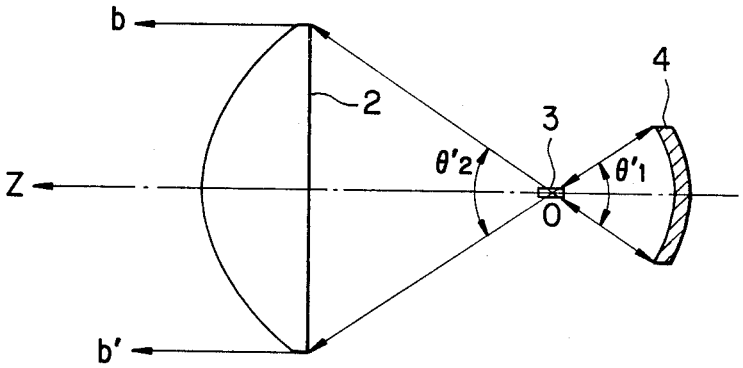
Fig. 2 (PRIOR ART)
FIG. 2 is an explanatory schematic drawing of the optical system of another conventional projector-type headlamp proposed to overcome the drawbacks of the optical system shown in FIG. 1, in which a single spherical surface is used as the concave mirror.
Figure 3:
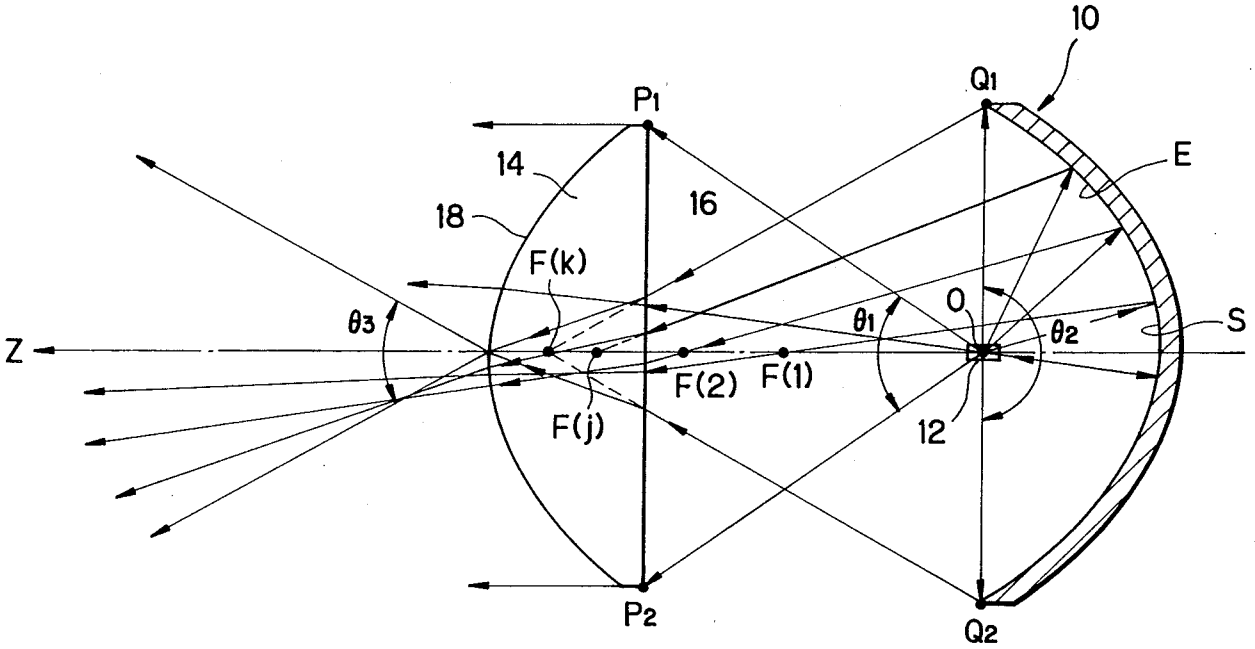
FIG. 3 is a schematic drawing of the optical system in one embodiment of the projector-type headlamp according to the present invention, the concave mirror being illustrated in a horizontal sectional view.
Figure 4:
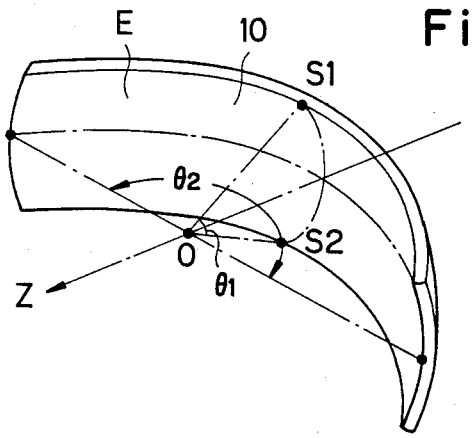
FIG. 4 is a schematic perspective view of the concave mirror shown in FIG. 3.
Figure 5:
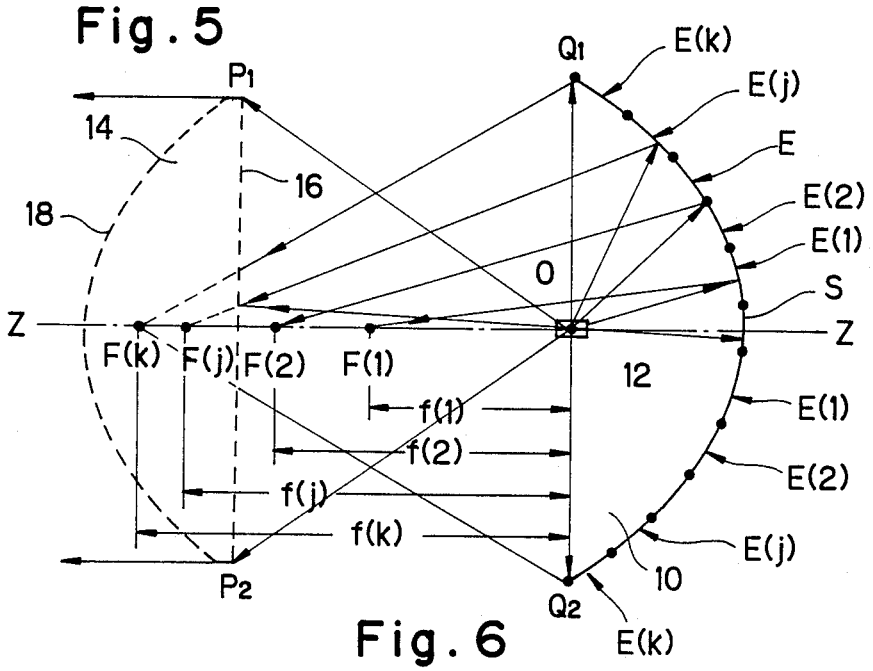
FIG. 5 is a drawing explaining the reflecting characteristics of a plurality of different ellipsoidal surfaces of revolution forming the concave mirror shown in FIG. 3.

Referring now to FIGS. 3 to 6, one embodiment of the projector-type headlamp according to the present invention will be described. FIG. 3 shows the optical system of the projector-type headlamp, comprising a concave mirror 10, a lamp bulb 12 as a light source disposed on the optical axis Z—Z of the concave mirror 10, and a convex lens 14 disposed in front of the lamp bulb 12 and having the optical axis thereof disposed nearly coincident with the optical axis Z—Z of the concave mirror 10. The concave mirror 10 according to the present invention is composed of a central spherical area S formed by a part of a spherical surface having whose center is at the point O on the optical axis Z—Z, and a composite ellipsoidal surface of revolution E formed by parts of a plurality of different ellipsoidal surfaces of revolution joined to the central spherical area S. The lamp bulb 12 has its filament center disposed as nearly coincident with the center O of the central spherical area S and the convex lens 14 has its focus disposed as nearly coincident with the center O of the central spherical area S. The composite ellipsoidal surface of revolution formed by parts of the plurality of different ellipsoidal surfaces of revolution will be described in further detail. The composite ellipsoidal surface of revolution E in this embodiment has its focus located at the center O of the central spherical area S as shown in FIG. 5, and it is formed from a number k of different ellipsoidal surfaces of revolution E(1), E(2), . . . , E(j) and E(k) smoothly joined to each other and having the other foci F(k) thereof at positions spaced a predetermined distance f(k) from the common focus O toward the convex lens 14. Namely, the ellipsoidal surface of revolution E(1) is formed by a part of an ellipsoidal surface of revolution having the two foci thereof located at the center O of the central spherical area S and the point F(1), respectively. Similarly, the ellipsoidal surfaces of revolution E(2), . . . , E(j) and E(k) are composed of parts of ellipsoidal surfaces of revolution having their two foci located at the center O of the central spherical area S and points F(1), F(2), . . . , F(j) and F(k), respectively. The distance f(k) between the two foci of the ellipsoidal surface of revolution E(k) becomes gradually larger as it goes farther away from the central spherical area S ($f(k) > f(j) > \ldots > f(2) > f(1)$). In this embodiment, the profile of the inner reflecting surface of the concave mirror 10 as viewed from the center of the convex lens 14 is a generally horizontal rectangle as shown in FIG. 4. The plurality of different ellipsoidal surfaces of revolution E(1), E(2), . . . , E(j) and E(k) are joined to the other adjoining ellipsoidal surfaces of revolution, respectively, in plural vertical planes parallel to the vertical plane in which the optical axis lies. The ellipsoidal surfaces of revolution E(1), E(2), . . . , E(j) and E(k) are composed of two elliptical reflecting areas, respectively, which are generally symmetrical with respect to the vertical plane in which the optical axis Z—Z' lies. The focus F(k) of the ellipsoidal surface of revolution E(K) formed at the farthest position from the central spherical area S and the focus F(j) of the ellipsoidal surface of revolution E(j) are located between a back surface 16 and frontal surface 18 of the convex lens 14, and the foci F(1), F(2), . . . of the ellipsoidal surfaces of revolution E(1), E(2), . . . are located between the point O and the back surface 16 of the convex lens 14. The composite ellipsoidal surface of revolution E, composed of the ellipsoidal surfaces of revolution E(1), E(2), . . . , E(j) and E(f), is so designed that the first angle $\theta 1$, obtained by viewing from the common focus 0 both the end points S1 and S2 of the line of intersection between the vertical plane in which the optical axis Z—Z lies and the central spherical area S, is nearly equal to the angle obtained by viewing from the common focus O both the end points P1 and P2 of the line of intersection between the convex lens 14, and the horizontal plane in which the optical axis Z—Z lies and the second angle $\theta 2$ obtained by viewing from the common focus O both the end points Q1 and Q2 of the line of intersection between the horizontal plane in which the optical axis Z—Z lies and the ellipsoidal surface of revolution E(k) formed at the farthest position from the central spherical area S is nearly 180 degrees. It will be obvious from the angular relation that the effective solid angle of the light rays emitted from the lamp bulb 12 can be made large and the rays can be utilized to full extent for definition of a predetermined luminous intensity distribution pattern.

Although only the four foci F(1), F(2), F(j) and F(k) are shown in the drawings for simplicity of the illustration, the composite ellipsoidal surface of revolution E is actually composed 40 to 50 different ellipsoidal surfaces of revolutions which are smoothly joined to each other. In this case, each ellipsoidal surface of revolution E(k) consists of two longitudinally elongated elliptical reflecting areas of about 1 mm in width, which are disposed in positions symmetrical with respect to a vertical plane in which the optical axis Z—Z lies, and each of these elliptical reflecting areas is formed by multiple fine reflecting surface elements of about $1 \times 1$ mm$^2$, which are smoothly joined longitudinally to each other. The technique for forming a reflecting curved surface having predetermined reflecting characteristics by thus joining multiple fine reflecting surface elements to each other is known and so will not be explained further.

Figure 6:
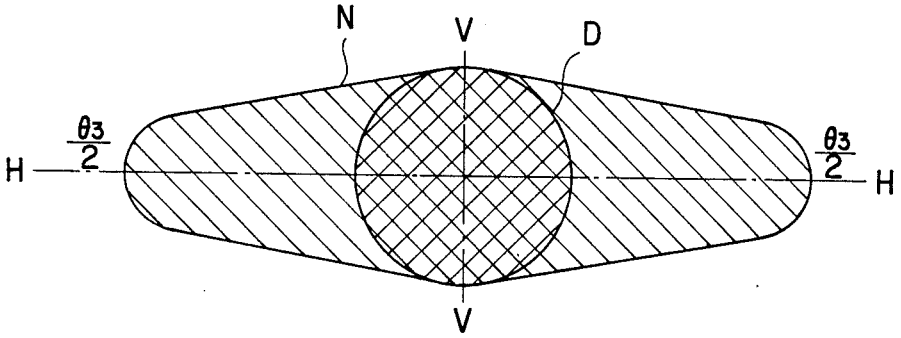
FIG. 6 is a schematic diagram of a luminous intensity distribution pattern defined as projected from the optical system shown in FIG. 3 onto a screen disposed in front of the convex lens.

The above-mentioned optical system of the projector-type headlamp according to the present invention will function as follows. First, the light rays emitted from the lamp bulb 12 and incident upon the central spherical area S are reflected toward near the common focus 0, further incident upon the back surface 16 of the convex lens 14, refracted in directions nearly parallel to the optical axis Z—Z and thus projected forward from the frontal surface 18. The rays emitted from the lamp bulb 14 and incident directly upon the back surface 16 of the convex lens 14 are also refracted in directions nearly parallel to the optical axis Z—Z and projected forward. A generally circular pattern D at the center in FIG. 6 is defined primarily by the rays emitted from the lamp bulb 12 and incident directly upon the convex lens 14. The rays emitted from the lamp bulb 12 and incident upon the ellipsoidal surfaces of revolution E(1), E(2), . . . , E(j) and E(k) in the composite ellipsoidal surface of revolution E are reflected toward the corresponding foci F(1), F(2), . . . , F(j) and F(k), refracted by the convex lens 14 crossing the optical axis Z—Z according to the respective angles of incidence upon the back surface 16, and projected forward from the frontal surface 18 as rays diverging horizontally within an angle $\theta 3$. The pattern, defined ahead of the convex lens 14 by the rays emitted from the lamp bulb 12, incident upon the composite ellipsoidal surface of revolution E and refracted by the convex lens 14, is indicated with N in FIG. 6. The pattern N extends from the center to the right and left within the angle $\theta 3$ and is superposed on the generally circular pattern D at the center to define a final luminous intensity distribution pattern required for the projector-type headlamp. For increasing the horizontal spreading of the final luminous intensity distribution pattern, it is desirable to locate between the back surface 16 and frontal surface 18 of the convex lens 14 the foci of the ellipsoidal surfaces of revolution distant from the central spherical area S, for example, not only E(j) and E(k) in this embodiment but also other ellipsoidal surfaces of revolution around them. Also the ellipsoidal surfaces of revolution can be so designed as to have their foci located ahead of the frontal surface 18 of the convex lens 14. In this embodiment, the reflecting area of the ellipsoidal surface of revolution E(k) formed at a farthest position from the central spherical area S is so designed that the second angle $\theta 2$ is essentially 180 degrees. This angular relation is the result of the consideration of the advantage in design. It is of course that the angle can be within an appropriate range larger or smaller than 180 degrees.

Figure 7:
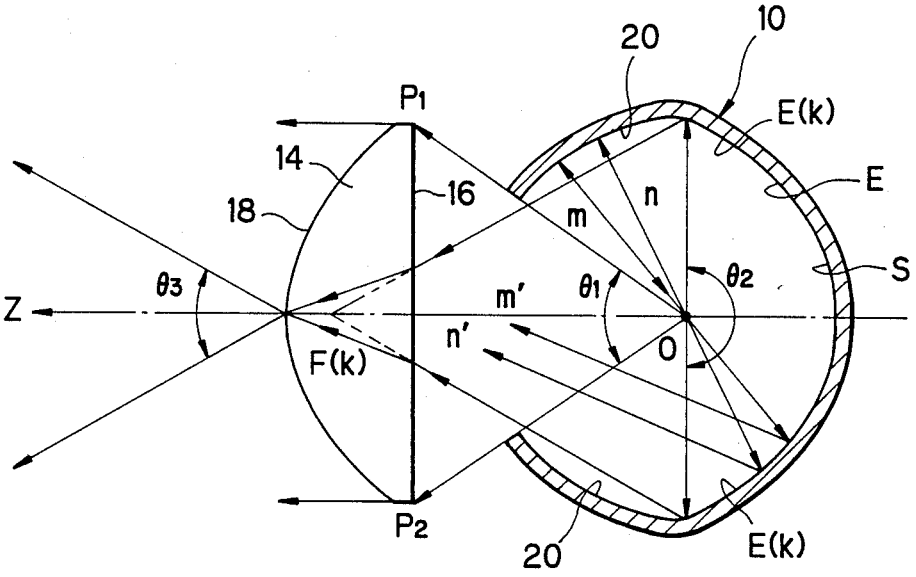
FIG. 7 is a schematic diagram of the optical system of another embodiment of the projector-type headlamp according to the present invention.
Figure 8:
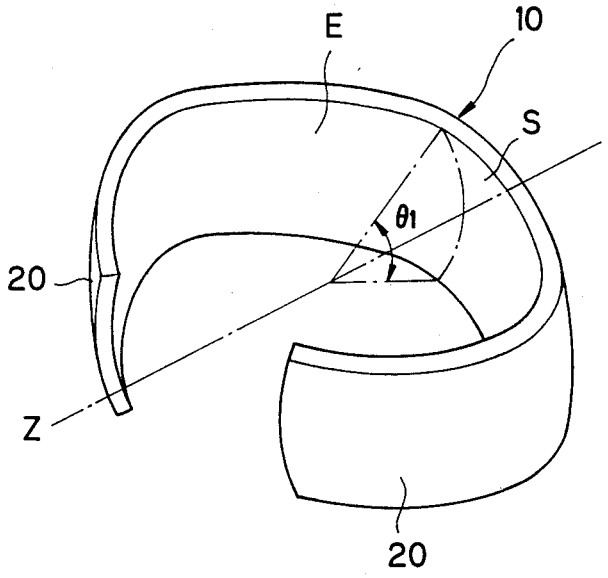
FIG. 8 is a schematic perspective view of the concave mirror shown in FIG. 7.

FIGS. 7 and 8 show another embodiment of the projector-type headlamp according to the present invention. FIG. 7 is a schematic drawing of the optical system, and FIG. 8 is a schematic perspective view of the concave mirror. In these Figures, the same reference numerals and symbols as in the Figures referred to in connection of the first embodiment indicate the same elements in the first embodiment. In this second embodiment, the concave mirror is formed by joining supplemental reflecting surfaces 20 to the ellipsoidal surface of revolution E(k) located at the farthest position from the central spherical area S. The supplemental reflecting surfaces 20 in this embodiment are formed as a part of a spherical surface taking as center the common focus O of the composite ellipsoidal surface of revolution E or a spherical surface taking as center a point a little away from the common focus O, and connected to two right and left reflecting areas, respectively, of the ellipsoidal surface of revolution E(k). Namely, these rays, emitted forward from the lamp bulb 12 that are emitted in directions exceeding the angle $\theta 1$ obtained by viewing from the common focus O both the end points P1 and P2 of the line of intersection between the convex lens 14 and the horizontal plane in which the optical axis Z—Z lies, can contribute to a luminous intensity distribution pattern To this end the supplemental reflecting surfaces 20 are extended from the two right and left reflecting areas of the ellipsoidal surface of revolution E(k) in such a range that the rays emitted from the lamp bulb 12 and incident directly upon the back surface 16 of the convex lens 14 are not blocked. The rays emitted from the lamp bulb 12 and incident upon the supplemental reflecting surfaces 20, for example, the ones incident from the directions indicated with m and n in FIG. 7, are reflected toward the lamp bulb 12 and further incident upon any of the ellipsoidal surfaces of revolution in the composite ellipsoidal surface E. Therefore, the rays reflected at the supplemental reflecting surfaces 20 are reflected at the ellipsoidal surfaces of revolution in the directions indicated with m' and n', respectively, that is, in directions toward the other foci than the common focus O. According to this embodiment, the supplemental reflecting surfaces 20 are formed by a part of a spherical surface. They can be formed by a curved surface which reflects toward the composite ellipsoidal surface of revolution E those rays emitted forward from the lamp bulb 12 in directions exceeding the angle $\theta 1$ obtained by viewing from the common focus O both the end points Pl and P2 of the line of intersection between the convex lens 14 and the horizontal plane in which the optical axis Z—Z lies.

What is claimed is:

1. A projector-type headlamp, comprising:

a concave mirror having an inner reflecting surface, an apex and an axis a lamp bulb as light source of which a center nearly falls on the axis of said concave mirror; and a convex lens so disposed as to have an optical axis thereof nearly coincident with the axis of said concave mirror, the inner reflecting surface of said concave mirror being composed, at an area near the apex, of a central spherical area formed by a part of a spherical surface and having a center thereof disposed on the axis of said concave mirror and a composite ellipsoidal surface of revolution formed by parts of a plurality of ellipsoidal surfaces of revolution smoothly joined to each other for junction with said central spherical area, having a common focus at the center of said spherical area and other foci at positions spaced a predetermined distance from said common focus toward said convex lens, said lamp bulb being having the center thereof disposed near said common focus and said convex lens having the focus thereof disposed near said common focus.

2. A projector-type headlamp as set forth in claim 1, wherein the inner reflecting surface of said concave mirror has a profile as viewed from the center of said convex lens is generally a horizontally elongated rectangle and each of said plural different ellipsoidal surfaces of revolution are joined to the other adjoining ellipsoidal surface of revolution in a vertical plane parallel to a vertical plane in which said optical axis lies.

3. A projector-type headlamp as set forth in claim 2, wherein each of said ellipsoidal surfaces of revolution is composed of two elliptical reflecting areas symmetrical with respect to the vertical plane in which said optical axis lies.

4. A projector-type headlamp as set forth in claim 3, wherein the two foci of each of said plural ellipsoidal surfaces of revolution are separated by a distance which becomes gradually larger as it goes further away from said central spherical area.

5. A projector-type headlamp as set forth in claim 4, wherein the other focus of the ellipsoidal surface of revolution formed at a position far from said central spherical area is located ahead of a back surface of said convex lens.

6. A projector-type headlamp as set forth in claim 5, wherein a first angle of viewing from said common focus to both end points of a line of intersection between the vertical plane in which said optical axis lies and said central spherical area is generally equal to an angle of viewing from said common focus to both end points of a line of intersection between said convex lens and the horizontal plane in which said optical axis lies, and a second angle of viewing from said common focus to both end points of a line of intersection between a horizontal plane in which said optical axis lies and the ellipsoidal surface of revolution located at the farthest position from said central spherical area is substantially about 180 degrees.

7. A projector-type headlamp as set forth in claim 6, further comprising supplemental reflecting surfaces joined to the ellipsoidal surface of revolution formed at a position farthest from said central spherical area and which reflect toward any of said plural ellipsoidal surfaces of revolution rays emitted from said lamp bulb in directions exceeding said first angle and toward said convex lens.

8. A projector-type headlamp as set forth in claim 7, wherein said supplemental reflecting surfaces are formed as a part of a spherical surface having the center thereof located near said common focus.

* * * * *